United States Patent [19]

Toutant

[11] Patent Number: 4,530,408

[45] Date of Patent: Jul. 23, 1985

[54] PORTING SYSTEM FOR PNEUMATIC IMPACT HAMMER

[76] Inventor: Roland J. Toutant, Rte. 193, Thompson, Conn. 06277

[21] Appl. No.: 479,716

[22] Filed: Mar. 28, 1983

[51] Int. Cl.[3] ..... B23Q 5/033

[52] U.S. Cl. ..... 173/17; 173/134; 173/136

[58] Field of Search ..... 173/17, 134, 136, 137, 173/93.6, 73, 78, 66; 91/234; 92/85 B

[56] References Cited

U.S. PATENT DOCUMENTS

| | | | |
|---|---|---|---|
| 884,419 | 4/1908 | Richards . | |
| 1,518,124 | 12/1924 | Mercer . | |
| 1,570,379 | 1/1926 | Gilman . | |
| 1,605,713 | 11/1926 | Gilman . | |
| 2,947,519 | 8/1960 | Feucht . | |
| 3,198,264 | 8/1965 | Oelke et al. . | |
| 3,503,459 | 3/1970 | Schindler . | |
| 3,735,820 | 5/1973 | Curington | 173/78 |
| 3,826,316 | 6/1974 | Bassinger | 173/73 |
| 3,866,746 | 2/1975 | Curington | 173/73 |
| 3,896,886 | 6/1975 | Roscoe, Jr. | 173/17 |
| 3,970,153 | 6/1976 | Gien et al. | 173/17 |
| 4,015,670 | 4/1977 | Rear | 173/15 |
| 4,054,180 | 10/1977 | Bassinger | 173/136 |
| 4,084,646 | 4/1978 | Kurt | 173/17 |
| 4,084,647 | 4/1978 | Lister | 173/73 |
| 4,094,366 | 6/1978 | Gien et al. | 173/138 |
| 4,312,412 | 1/1982 | Pillow | 173/17 |
| 4,333,537 | 6/1982 | Harris et al. | 173/17 |
| 4,402,370 | 9/1983 | Gien et al. | 173/135 |

FOREIGN PATENT DOCUMENTS

| | | | |
|---|---|---|---|
| 1552975 | 9/1979 | United Kingdom | 173/17 |

*Primary Examiner*—Donald R. Schran
*Assistant Examiner*—James Wolfe
*Attorney, Agent, or Firm*—Prutzman, Kalb, Chilton & Alix

[57] ABSTRACT

A pneumatic downhole impact drill having a porting system for automatically and sequentially supplying pneumatic pressure fluid from a fluid delivery tube received within a central coaxial bore in an impact piston to the opposite ends of the piston operating cylinder as the piston reciprocates and for selectively and automatically connecting the non-impact end of the cylinder to exhaust via the coaxial bore in the piston as the piston reciprocates. The porting system provides two separate paths for supplying pneumatic pressure fluid to the non-impact end of the cylinder and employs annular porting grooves and internal drilled porting bores in only the non-impact end of the piston to minimize stress concentration from piston impact.

22 Claims, 7 Drawing Figures

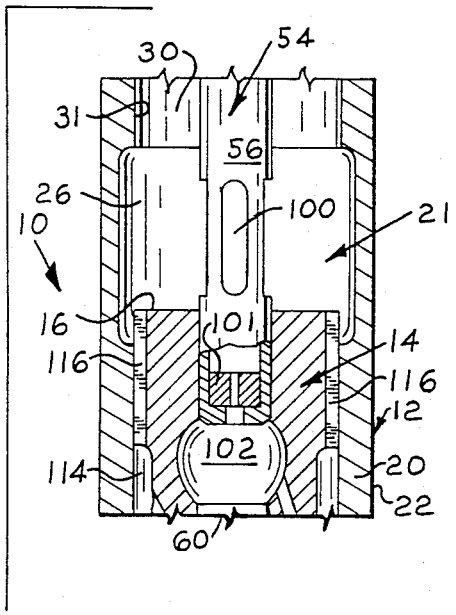
FIG. 6
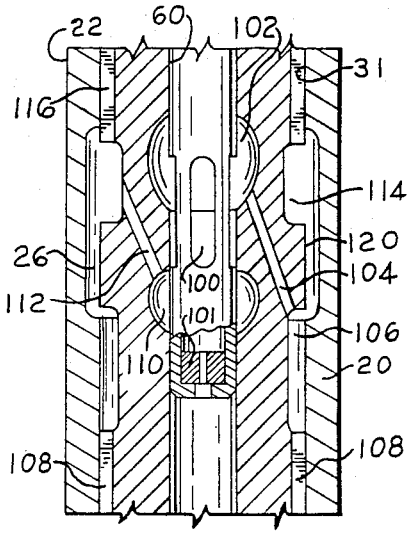
FIG. 5
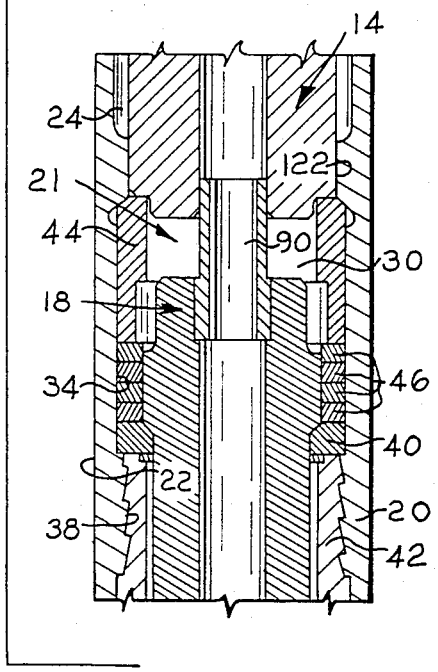

PORTING SYSTEM FOR PNEUMATIC IMPACT HAMMER

SUMMARY OF THE INVENTION

The present invention relates generally to pneumatic impact hammers of the type having notable utility in downhole drills and employing an impact piston reciprocable within a piston operating cylinder and pneumatically operated for impacting a drill bit or other percussive member at a high frequency by automatically and sequentially connecting the opposite ends of the piston operating cylinder to a high pressure pneumatic source and to exhaust.

It is a principal aim of the present invention to provide in a pneumatic impact hammer of the type described, a new and improved porting system for automatically and sequentially supplying pneumatic pressure fluid from a pneumatic pressure fluid delivery tube received within a central axial bore in the impact piston to the opposite ends of the piston operating cylinder as the piston reciprocates. In accordance with this aim of the present invention, the pneumatic pressure fluid is sequentially supplied to the opposite ends of the cylinder by a new and improved system of ports in the piston, delivery tube and piston cylinder.

It is another aim of the present invention to provide a new and improved impact hammer of the type described, which employs a pressure fluid delivery tube, impact piston and piston operating cylinder of economical design and configured to cooperate in a new and improved manner for automatically and sequentially supplying pressure fluid to the opposite ends of the piston operating cylinder as the piston reciprocates and for automatically connecting the non-impact end of the piston operating cylinder to exhaust.

It is a further aim of the present invention to provide for use in a pneumatic impact hammer of the type described, a novel and advantageous impact piston configuration for use in automatically and sequentially supplying pressure fluid to the opposite ends of the piston operating cylinder as the piston reciprocates and which employs internal passages in only the non-impact end of the piston to minimize stress concentration within the piston from the usual high piston impact force.

It is a further aim of the present invention to provide in a pneumatic impact hammer of the type described, a new and improved method for automatically and sequentially supplying pressure fluid to the opposite ends of the piston operating cylinder.

It is another aim of the present invention to provide a new and improved pneumatic downhole impact hammer of the type described which employs a one-piece, outer tubular casing for mounting the impact piston for reciprocation and a central delivery tube received within an axial bore of the piston for supplying pressure fluid sequentially to the opposite ends of the piston operating cylinder via pressure fluid conducting passages within the piston.

It is a further aim of the present invention to provide a new and improved downhole impact hammer which may be economically manufactured and wherein an outer wear sleeve of the hammer has a simple and economical configuration and therefore may be replaced, for example due to normal wear, at a relatively low cost.

Other objects will be in part obvious and in part pointed out more in detail hereinafter.

A better understanding of the invention will be obtained from the following detailed description and the accompanying drawings of an illustrative application of the invention.

BRIEF DESCRIPTION OF DRAWINGS

In the drawings,

FIGS. 4 and 5 are partial axial section views, partly broken away and partly in section, of the downhole drill, showing respectively, the impact piston in a representative raised or withdrawn top dead center position and in a position intermediate its raised and impact positions; and FIG. 6 is a partial axial section view, partly broken away and partly in section, of the downhole drill showing a drill bit and impact piston of the downhole drill in extended or blow positions thereof.

DESCRIPTION OF THE PREFERRED EMBODIMENT

Figure 1A:
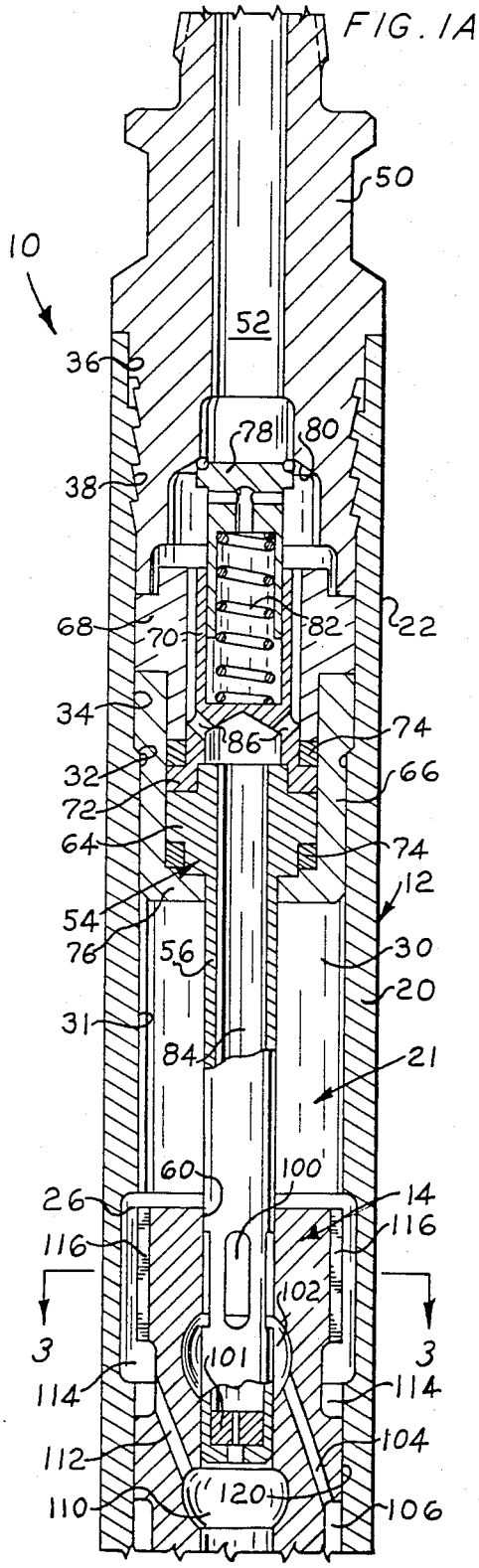
FIGS. 1A and 1B together provide an axial section view, partly broken away and partly in section, of a downhole impact drill incorporating an embodiment of the present invention and showing an impact piston of the drill in a lower or impact position thereof.
Figure 1B:
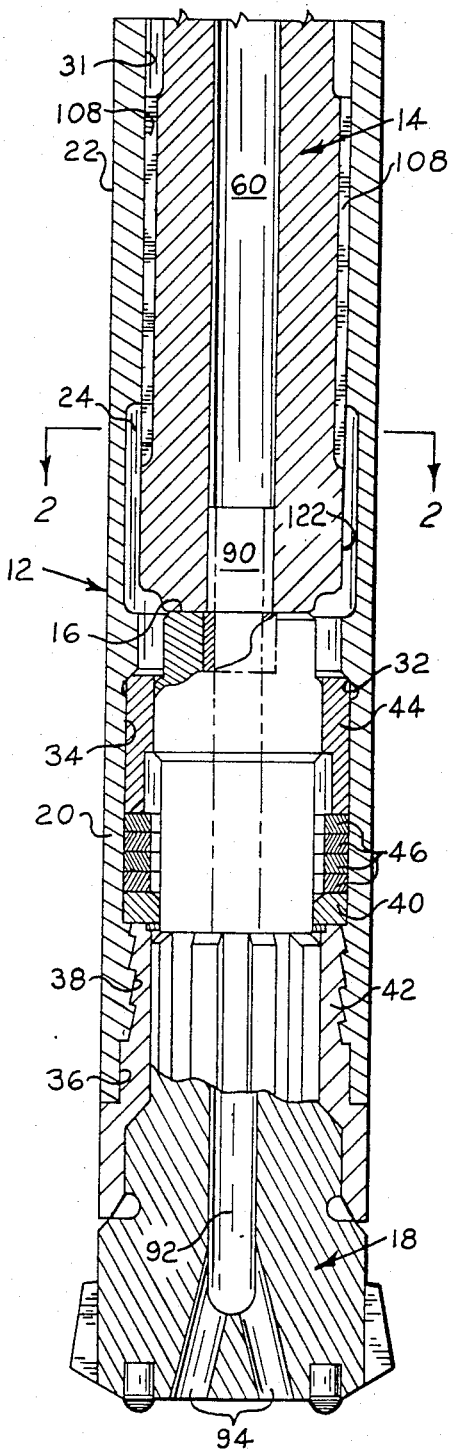
Figure 2:
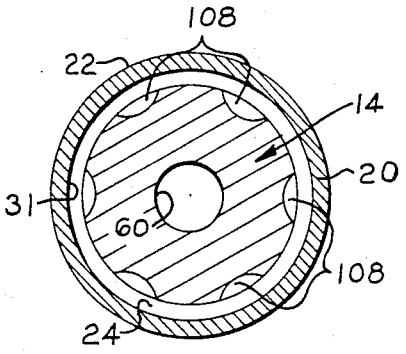
FIGS. 2 and 3 are transverse section views, partly in section, of the downhole drill taken substantially along lines 2—2 and 3—3 of FIGS. 1B and 1A respectively.
Figure 3:
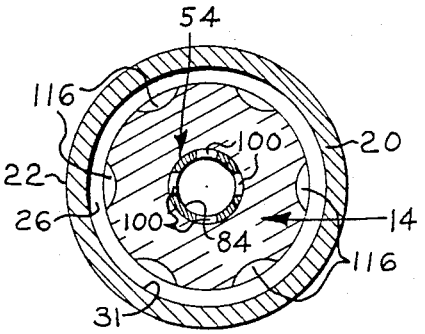
Figure 4:
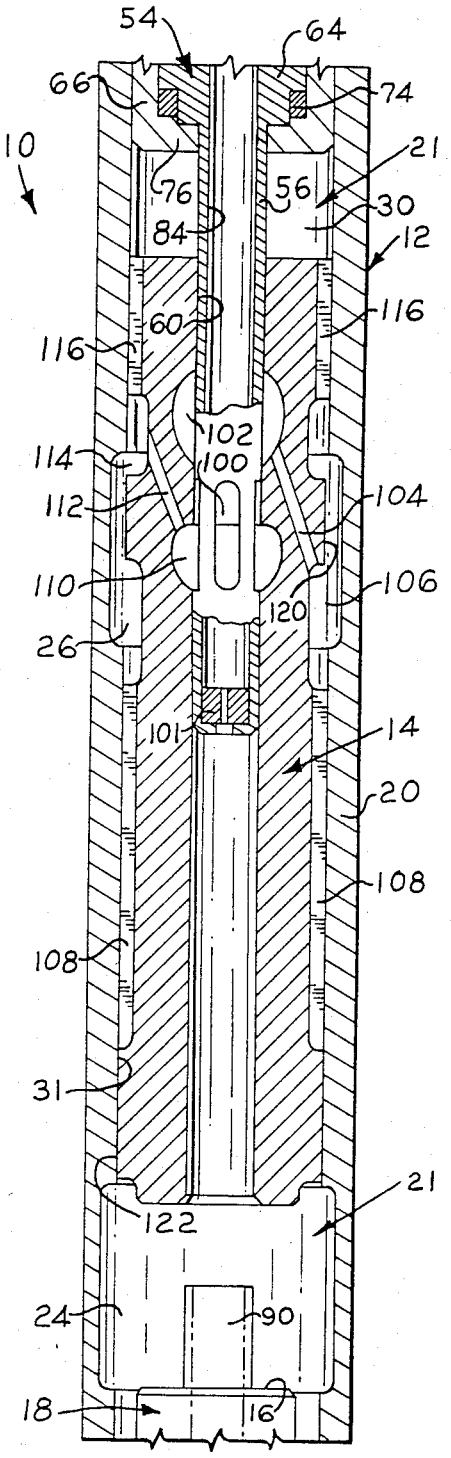

Referring now to the drawings in detail, wherein like numerals designate the same or like parts, a downhole drill 10 having a pneumatic impact hammer 12 incorporating a preferred embodiment of the present invention is shown in FIGS. 1A and 1B with an axially elongated impact piston 14 of the hammer in a lower or impact position in engagement with an upper anvil end face 16 of a percussive bit 18 and in FIG. 4 with the piston 14 in a representative raised or withdrawn top dead center position. An outer, elongated, tubular casing or wear sleeve 20 of the hammer 12 provides an internal piston operating cylinder 21 intermediate the ends of the casing 20 for mounting the piston 14 for linear reciprocation. As described more fully hereinafter, the piston 14 is adapted to be reciprocated to impact the drill bit 18 at a high frequency for downhole percussive drilling in a well-known manner.

The elongated tubular casing 20 has an outer cylindrical surface 22 and the drill bit 18 has an effective cutting diameter which is at least slightly greater than the outside diameter of the casing 20. The length of the intermediate piston operating chamber or cylinder 21 and therefore the length of the tubular casing 20 is selected in part in accordance with the potential maximum stroke of the impact piston 14. The actual stroke is primarily a function of the pneumatic inlet and exhaust timing for the opposite ends of the piston operating cylinder, the piston weight, the actual pneumatic operating pressure and the drill back pressure at the bottom of the drilled hole, whereas the preferred or optimum piston stroke is dependent on the drill application, drilling depth, available pneumatic operating pressure and capacity, and type of rock, etc. being drilled.

Except for a pair of axially spaced internal, annular bypass ports or grooves 24, 26 in the casing 20, the bore 30 of the casing 20 has a continuous, constant diameter, cylindrical surface 31 between a pair of tapered, axially outwardly facing, radial locating shoulders 32 of the casing. The two end sections of the casing 20 which extend outwardly from the locating shoulders 32 preferably have generally the same internal configuration which comprises an inner cylindrical bore section 34 adjacent the tapered shoulder 32, an outer slightly larger cylindrical bore section 36 and an intermediate threaded bore section 38.

The drill bit 18 may be of standard design and is coaxially mounted within the lower end of the casing 20 in a generally conventional manner. The bit 18 is axially shiftable within the casing between an upper drilling position shown in FIG. 1B and a lower blow position shown in FIG. 6 where it is supported on a bit retaining ring 40 and an externally threaded chuck or coupling 42 screwed into the lower end of the casing 20. The chuck 42 and bit 18 have respective internal and external splines to provide a spline connection for rotation of the bit 18 during drilling in a conventional manner. The bit 18 can be readily removed for repair or replacement by unscrewing the chuck 42 from the lower end of the casing 20. A bit stem bearing or guide sleeve 44 is mounted within the casing 20 in engagement with the lower internal shoulder 32 of the casing, and suitable Belville compression rings 46 are provided between the stem bearing 44 and bit retaining ring 40.

A backhead 50 is coaxially mounted within the upper threaded opening of the casing. The backhead has an external thread at its upper end to provide for coupling the downhole drill 10 to a suitable drill string (not shown) in a conventional manner. The backhead 50 has a central axial through bore 52 for conducting pneumatic pressure fluid from the drill string (not shown) to the interior of the hammer. The pneumatic pressure fluid used for operating downhole hammers typically comprises compressed air at a high pressure of up to 350 psi or greater to which is added a selected amount of lubricating oil and water coolant.

A central, axially extending pressure fluid conductor or supply tube 54 is provided for conducting pneumatic pressure fluid (a) for reciprocating the impact piston 14, and (b) in addition, if desired, continuously to the lower end of the drill 10 to provide additional air flow for assisting in removing pulverized rock, water, etc. from the bottom of the drilled hole. The fluid conductor 54 has a depending cylindrical delivery tube 56 coaxial with the piston cylinder and received within a central, coaxial, cylindrical through bore 60 in the piston 14. The O.D. of the depending cylindrical delivery tube 56 and the diameter of the cylindrical bore 60 in the piston are dimensioned to provide a suitable fluid seal therebetween.

The fluid conductor 54 has an upper, enlarged, integral support hub 64 received within a coaxial bore of a retainer cup 66. The retainer cup 66 has a lower, depending, slightly reduced cylindrical portion snugly received within the cylindrical bore 30 of the casing and a slightly enlarged upper cylindrical portion having a downwardly facing, external radial shoulder conforming to and engaging the upper internal locating shoulder 32 of the casing 20. A spacer sleeve 68 is mounted within the casing between the upper end of the retainer cup 66 and the lower end of the backhead 50 to hold the retainer cup 66 against the upper locating shoulder 32.

A check valve support 70 is mounted within a through bore in the spacer sleeve 68 and has a lower circular end flange 72 snugly received within the retainer cup bore between the upper end of the hub 64 and a lower reduced end section of the spacer sleeve 68. A suitable resilient compression ring 74 is provided between the hub 64 and a lower annular support flange of the retainer cup 66. For that purpose, the lower end of the hub 64 has a suitable annulus for mounting the compression ring 74. A similar or identical compression ring 74 is provided between the inner end of the retainer sleeve 68 and the lower end flange 72 of the check valve support 70. Thus, the fluid conductor hub 64 is mounted between two compression rings 74 to ensure that the delivery tube 56 is firmly mounted for proper cooperation with the impact piston 14.

A linear, one-way check valve plunger 78 is mounted within a central coaxial bore in the check valve support 70. A resilient "O" ring seal is mounted within a peripheral annular groove in the upper end of the check valve plunger 78 to engage a tapered valve seat 80 provided by an enlarged stepped counterbore in the lower end of the blackhead 50. A suitable compression spring 82 is provided for urging the check valve 78 into engagement with its seat 80 to prevent reverse flow from the drilled hole into the downhole hammer 12 when the pneumatic pressure fluid supplied to the drill 10 is shut off, for example, during drilling when a drill string section (not shown) is being added at the top of the existing drill string (not shown). With pneumatic pressure fluid supplied to the hammer and during normal drilling operation with the downhole drill, the check valve 78 is depressed or opened inwardly by the pressure fluid for conducting the pressure fluid to an internal cylindrical bore 84 of the fluid conductor 54 via an annular passageway between the spacer sleeve 68 and check valve support 70, an annular arrangement of four equiangularly spaced and downwardly and inwardly inclined, drilled radial holes 86 in the check valve support 70 and a counterbore in the lower end of the check valve support 70.

By unscrewing the backhead 50 from the casing 20, the entire subassembly of parts mounted within the upper end of the casing and also the impact piston 14 can be readily removed for repair or replacement. Likewise, by unscrewing the chuck 42 from the casing, the entire subassembly of parts mounted within the lower end of the casing and also the impact piston 14 can be readily removed for repair or replacement.

During normal drilling operation, the drill bit 18 remains in its upper, drilling position shown in FIG. 1B in engagement with the lower end of the chuck 42, and a continuous downward force is applied to the drill bit 18 via the drill string (not shown), backhead 50, casing 20 and chuck 42. For reciprocating the piston 14, the opposite axial ends of the impact piston operating cylinder 21 are sequentially connected to exhaust and to receive pneumatic pressure fluid from the depending fluid delivery tube 56. Pressure fluid is timely supplied to the upper or non-impact end of the piston operting cylinder, first to decelerate the upward movement of the piston and then to actuate the piston downwardly to impact the drill bit 18. The upper end of the cylinder 21 is timely connected to exhaust and pressure fluid is timely supplied to the lower end of the cylinder 21 to raise or withdraw the piston 14 for a succeeding impact stroke. The lower or impact end of the piston operating cylinder is timely connected to exhaust to permit the piston to be actuated downwardly by the fluid pressure in the upper end of the cylinder. The exhaust connection to the lower end of the cylinder is provided in a conventional manner by an upstanding exhaust tube 90 mounted on the upper end of the drill bit 18, a central axial bore 92 in the bit 18 and lower inclined bores 94 in the bit 18 leading to the lower working end face of the bit. The exhaust tube 90 is dimensioned for receipt within the lower end of the central axial bore 60 in the impact piston 14 as shown in FIG. 1B to provide an effective exhaust seal for the lower end of the cylinder. As can be seen, the length of the upstanding exhaust tube 90 above the upper end face 16 of the bit 18 determines the exhaust timing at the impact end of the cylinder 21. Accordingly, that exhaust timing is established by employing an exhaust tube 90 of appropriate length.

Pneumatic pressure fluid is supplied from the depending fluid delivery tube 56 via an annular arrangement of four peripheral, circumferentially aligned and equiangularly spaced, axial slots or ports 100 in the delivery tube 56. Also, as shown in FIG. 1A, a relatively small amount of pneumatic pressure fluid may be supplied continuously through the lower end of the delivery tube 56 to the central exhaust passageway in the drill 10 to assist in removing pulverized rock particles, water, etc. from the bottom of the drilled hole. For that purpose, a plug 101 mounted in the lower end of the axial bore 84 in the delivery tube is provided with a small axial orifice. The central exhaust passageway in the drill 10 is provided by the central axial bore 60 in the piston 14 below the delivery tube 56, the upstanding exhaust tube 90, and the central axial bore 92 and inclined bores 94 in the drill bit 18.

The pressure fluid is supplied from the peripheral supply ports 100 in delivery tube 56 to the lower end of the cylinder via an upper, inner annular port or groove 102 in the piston 14 which opens into the axial bore in the piston and an annular arrangement of six equiangularly spaced, axially outwardly and downwardly inclined radial ports or bores 104 drilled in the piston (only one of which is shown) which connect the upper inner annular groove 102 in the piston 14 to a lower, peripheral annular port or groove 106 in the piston. The lower, peripheral annular groove 106 in the piston 14 forms an annular pressure chamber surrounding the piston for supplying pneumatic pressure fluid via an annular arrangement of six equiangularly spaced, elongated, peripheral axial grooves or ports 108 in the piston 14 and the lower bypass groove 24 in the casing 20 to the lower end of the piston operating cylinder 21.

With the impact piston 14 in engagement with the drill bit 18 as shown in FIG. 1B, the upper end of the piston operating cylinder 21 is connected to the central exhaust passageway of the drill as shown in FIG. 1A by means of a lower, inner annular port or groove 110 in the piston 14 which opens into the axial bore 60 in the piston and which is then positioned below the lower end of the fluid delivery tube 56. An annular arrangement of six equiangularly spaced, axially upwardly and outwardly inclined radial ports or bores 112 drilled in the piston (only one of which is shown) connect the lower, inner annular groove 110 in the piston 14 to an upper, peripheral annular port or groove 114 in the piston. The upper, peripheral annular groove 114 forms an annular fluid chamber surrounding the piston for supplying pressure fluid to and exhausting pressure fluid from an upper end of the piston operating cylinder 21 via an annular arrangement of six equiangularly spaced, peripheral axial ports or grooves 116 in the upper end of the piston 14 extending between the upper peripheral annular groove 114 and the upper or non-impact end face of the piston. A peripheral ungrooved or sealing section 120 of the piston 14 is provided at the upper end of the piston between the upper and lower peripheral annular grooves 114, 106 in the piston 14.

Thus, with the impact piston 14 in engagement with the drill bit 18 as shown in FIG. 1B, pressure fluid is supplied to the lower end of the piston operating cylinder 21 and the upper end of the piston operating cylinder 21 is connected to exhaust to provide for raising or withdrawing the piston 14 from the bit 18 for a succeeding downward impact stroke. As the piston is actuated upwardly, the fluid pressure connection to the lower end of the cylinder 21 is terminated by sealing off the pressure fluid flow via the lower bypass groove 24 in the casing 20 with a lower, peripheral, ungrooved or sealing section 122 of the piston 14. In other words, when the piston 14 is raised sufficiently to withdraw the lower peripheral axial ports 108 in the piston 14 out of registry with the lower bypass port 24 in the casing 20, the supply of pressure fluid to the lower end of the cylinder 21 is terminated. However, the piston 14 continues to be actuated upwardly by the pneumatic fluid pressure below the piston until after the drill bit exhaust tube 90 is uncovered to connect the lower end of the cylinder 21 to exhaust.

Referring to FIG. 5, as the piston 14 is actuated upwardly from the drill bit 18, the upper annular bypass port 26 in the casing 20 becomes operative to connect the lower peripheral annular port 106 in the piston 14 for supplying pressure fluid to the upper end of the cylinder 21. Also, as the piston 14 is actuated upwardly from the drill bit 18, the lower inner annular port 110 in the piston is first sealed off by the lower end of the delivery tube 56 and then moves into registry with the peripheral supply ports 100 in the delivery tube 56 to supply pressure fluid to the upper end of the piston operating cylinder 21. Accordingly, high pressure fluid is supplied to the upper end of the cylinder via two separate supply routes (i.e. via the two sets of radial bores 104, 112 in the piston 14) to accelerate the rate of pressure increase in the upper end of the cylinder 21. The inlet timing for the two separate supply routes are determined independently by the axial location of the upper bypass groove 26 in the casing 20 and the axial location of the lower end of the supply ports 100 in the delivery tube 56. The inlet timing for the two separate supply routes may be different, in which event they preferably overlap as in the disclosed embodiment. Specifically, in the disclosed embodiment, the upper bypass groove 26 cooperates with the lower peripheral annular groove 106 in the piston 14 to provide earlier inlet timing and threby also provide more controlled piston operation and greater design flexibility. Also, the two separate supply routes can be used to supply pressure fluid at successive, relatively lower and higher rates during a longer part of the upward stroke of the piston, thereby to maintain the pressure fluid in the upper end of the cylinder 21 during a longer part of the downward or impact stroke. As shown in FIG. 4, the earlier inlet supply route provided in part by the upper, inner annular port 102 in the piston 14 may be closed before the piston reaches its fully withdrawn position, by the movement of the upper, inner annular port 102 out of registry with the delivery tube supply ports 100. During the downward or impact stroke of the piston, the lower, inner annular port 110 in the piston moves out of registry with the supply ports 100 in the fluid delivery tube 56 and then the upper peripheral sealing section 120 of the piston 14 seals off the flow to the upper end of the cylinder 21 via the upper bypass port 26. The pressure fluid in the upper end of the cylinder 21 continues to actuate the piston downwardly and after predetermined further downward movement of the piston 14, the lower, inner annular port 110 in the piston 14 is opened to the axial bore 60 in the piston below the delivery tube to connect the upper end of the piston operating cylinder 21 to exhaust. Therefore, the exhuast timing for the upper end of the cylinder 21 is dependent on the length of the delivery tube 56.

Referring to FIG. 6, a blow condition of the downhole drill is provided in a conventional manner by raising the drill 10 with the drill string (not shown) to support the drill bit 18 on the bit retaining ring 40. In that blow condition with the impact piston 14 resting on the stem bearing 44, the delivery tube supply ports 100 are opened to the upper end of the piston operating cylinder 21. Pressure fluid is thereby supplied from the delivery tube supply ports 100 directly to the upper end of the cylinder and then via the upper, peripheral annular groove 114 and lower, inner annular groove 110 in the piston 14 to the central exhaust passageway leading to the lower end face of the drill bit 18. The blow condition of the downhole drill thereby provides for supplying pneumatic pressure fluid at a relatively high rate to the bottom of the drilled hole. Also, in the blow position of the impact piston 14 shown in FIG. 6, the lower end of the cylinder below the piston is closed off by the lower sealing section 122 of the piston 14. In addition, the lower end of the cylinder 21 is suitably connected to exhaust in a conventional manner along the exterior of the drill bit 18 via annular passageways provided by reduced end and intermediate sections of the drill bit 18 and by an enlarged lower bore section of the stem bearing 44 and by axial passageways between the interfitting splines of the drill bit 18 and chuck 42. Also, the bit retainer ring 40 and compression rings 46 are suitably formed to provide for exhausting pressure fluid along the exterior of the bit.

As shown in the drawings, the upper and lower, inner and peripheral annular grooves 102, 110, 114, 106 in the piston 14 and the inclined radial bores 104, 112 in the piston provide two completely separate but axially overlapping or crossing passageways in the upper or non-impact one-half of the piston, in approximately the upper one-third of the piston. Consequently, since only a small fraction of the impact force from the piston 14 impacting the drill bit 18 is transmitted through that upper approximately one-third of the piston, the annular grooves 102, 106, 110, 114 and drilled bores 104, 112 in the piston 14 will not cause sufficient stress concentration to produce piston cracking. Accordingly, it is expected that the inner and peripheral annular grooves and inclined drilled bores in the upper end of the piston will not affect the life or durability of the piston. In addition, the inclined drilled bores 104, 112 in the piston are made relatively short and at the same angle of inclination to the piston axis to minimize the area of stress concentration and to reduce the fluid pressure drop between each pair of interconnected inner and peripheral grooves in the piston.

The piston 14 is supported by the casing 20 substantially along the full length of the piston 14 as the piston reciprocates (except along the two peripheral annular grooves 106, 114 in the piston and the two internal annular bypass grooves 24, 26 in the casing) to increase the life of the piston 14 and minimize the rate of external wear of the piston 14 and internal wear of the casing 20.

For any given piston configuration, the timing for supplying pressure fluid to and exhausting it from the opposite ends of the piston operating cylinder 21 is dependent on the axial location of the supply ports 100 in the delivery tube 56, the length of the delivery tube 56, the axial location of the internal bypass grooves 24, 26 in the casing 20 and the length of the exhaust tube 90. Thus, for any given piston configuration, the piston stroke can be modified by using a different length delivery tube 56 and/or different supply port location, and/or different bypass groove location, and/or different length exhaust tube 90. Accordingly, for any given piston configuration, the stroke of the piston can be modified for the available operating pressure and/or type of rock, etc. being drilled by proper selection of delivery tube 56, exhaust tube 90 and casing 20.

As will be apparent to persons skilled in the art, various modifications, adaptations and variations of the foregoing specific disclosure can be made without departing from the teachings of the present invention.

I claim:

1. In a downhole drill comprising a drill bit impact hammer having an elongated tubular casing with an axial through bore and an intermediate section providing an impact piston operating cylinder, an impact piston with a coaxial through bore mounted for axial reciprocation within the operating cylinder, and fluid conductor means mounted within one end of the casing for coupling the downhole drill to and receiving pneumatic pressure fluid from a drill string and comprising an elongated pressure fluid delivery tube extending coaxially within one end of the piston operating cylinder corresponding to said one end of the casing and sealingly received within the piston bore at a corresponding one end of the piston, the pressure fluid delivery tube having peripheral outlet port means for the delivery of pressure fluid for sequential supply to the opposite ends of the piston operating cylinder for and upon reciprocation of the piston, the impact piston having a non-impact end face at its said one end and an impact end face at its other end; and a drill bit having an inner end mounted within the casing at the other end of the piston operating cylinder from said delivery tube for impact by the impact end face of the piston, the drill bit having an exhaust conduit with an exhaust tube adapted for receipt within and withdrawal from the piston bore at said other end of the piston for selectively connecting said other end of the piston operating cylinder to exhaust for and upon reciprocation of the piston; the hammer having fluid passageway means to automatically supply pressure fluid from the peripheral outlet port means of the delivery tube sequentially to the opposite ends of the piston operating cylinder for and upon reciprocation of the piston and to selectively and automatically connect said one end of the piston operating cylinder to the exhaust conduit, via the piston bore at said other end of the piston and the exhaust tube, for and upon reciprocation of the piston, said fluid passageway means comprising first and second separate, axially spaced, inner annular grooves in the piston opening into the piston bore; the improvemment wherein said fluid passageway means comprises first and second separate, axially spaced peripheral groove means in the piston which include first and second separate, axially spaced peripheral annular grooves respectively in the piston, the said second annular groove providing a nonexhausted pressure fluid chamber, and first and second separate internal passage means in the piston interconnecting said first and second inner annular grooves respectively with said first and second peripheral annular groove respectively said first peripheral groove means and said second inner annular groove being disposed axially closer to the non-impact end face of the piston than said second peripheral groove means and said first inner annular groove respectively, said first inner annular groove and said first peripheral groove means being located to alternately connect said one end of the piston operating cylinder, via said first peripheral annular groove, to receive pressure fluid from said peripheral outlet port means and to exhaust via the piston bore at said other end of the piston for and upon reciprocation of the piston, the piston having first and second separate, axially spaced, peripheral sealing sections for sealing engagement with said intermediate section of the casing, said first peripheral sealing section being disposed between said first and second separate peripheral groove means and said second peripheral sealing section being disposed toward the impact end face of the piston from said second peripheral groove means, said fluid passageway means further comprising first and second separate, internal, axially spaced bypass grooves in said intermediate section of the casing cooperating with said first and second peripheral sealing sections respectively to sequentially supply pressure fluid from said peripheral outlet port means via said second inner annular groove, said second internal passage means, said second peripheral groove means, including said second peripheral annular groove, and said first and second bypass grooves to the opposite ends of the piston operating cylinder, when the said opposite ends respectively of the piston operating cylinder are not connected to exhaust, for and upon reciprocation of the piston.

2. A downhole drill according to claim 1 wherein said first and second peripheral sealing sections of the piston have the same diameter.

3. A downhole drill according to claim 1 wherein said first peripheral groove means further includes peripheral axial grooves in the piston extending between said first peripheral annular groove and the non-input end face of the piston.

4. A downhole drill according to claim 1 wherein said second peripheral groove means further includes peripheral axial grooves in the piston extending between said second peripheral annular groove and said second peripheral sealing section.

5. In a pneumatic impact device having a casing with a bore providing an impact piston operating cylinder, an impact piston with a coaxial through bore, mounted for axial reciprocation within the operating cylinder, a pneumatic pressure fluid delivery tube mounted to extend caoxially within one end of the piston operating cylinder and sealingly received within the piston bore at a corresponding one end of the piston, the impact piston having a non-impact end face at its said one end and an impact end face at its other end, the pressure fluid delivery tube having peripheral outlet port means for the delivery of pneumatic pressure fluid for sequential supply to the opposite ends of the piston operating cylinder for and upon reciprocation of the piston, and impact receiving means having an inner end mounted within the casing at the other end of the piston operating cylinder from said delivery tube for impact by the impact end face of the piston; the impact device having pressure fluid exhaust means in continuous fluid communication with the piston bore at said other end of the piston and cooperating with the piston for selectively connecting said other end of the piston operating cylinder to exhaust for and upon reciprocation of the piston, and fluid passageway means to automatically supply pressure fluid from the peripheral outlet port means of the delivery tube sequentially to the opposite ends of the piston operating cylinder for and upon reciprocation of the piston and to selectively and automatically connect said one end of the piston operating cylinder to exhaust via the piston bore at said other end of the piston and said exhaust means, for and upon reciprocation of the piston, said fluid passageway means comprising first and second separate fluid conducting means provided by the piston with respective first and second separate inner port means in the piston opening into the piston bore; said first fluid conducting means being located to selectively and alternately connect, for and upon reciprocation of the piston, said one end of the piston operating cylinder to said peripheral outlet port means via said first inner port means and to exhaust via the piston bore at said other end of the piston and the said exhaust means; the improvement wherein said second fluid conducting means comprises peripheral port means in the piston, including a peripheral annular groove in the piston providing a non-exhausted pressure fluid chamber, and internal passage means in the piston interconnecting said peripheral port means with said second inner port means, said piston having first and second axially spaced, peripheral sealing sections, respectively disposed toward the non-impact and impact end faces of the piston from said peripheral port means for sealing engagement with said casing, the fluid passageway means further comprising first bypass means in the casing cooperating with said second peripheral sealing section to selectively connect said peripheral outlet port means via said second fluid conducting means and said first bypass means to said other end of the piston operating cylinder, when said other end of the piston operating cylinder is not connected to exhaust, for and upon reciprocation of the piston.

6. A pneumatic impact device according to claim 5 wherein said fluid passageway means further comprises second bypass means in the casing cooperating with said first peripheral sealing section to selectively connect said peripheral outlet port means via said second fluid conducting means and said second bypass means to said one end of the piston operating cylinder, when said one end of the piston operating cylinder is not connected to exhaust, for and upon reciprocation of the piston.

7. A pneumatic impact device according to claim 6 wherein said first and second bypass means in the casing repectively comprises first and second separate, axially spaced internal annular grooves in the casing cooperating with said second and first peripheral sealing sections respectively to selectively connect said peripheral outlet port means via said second fluid conducting means to the opposite ends of the piston operating cylinder for and upon reciprocation of the piston.

8. A pneumatic impact device according to claim 5 wherein said first fluid conducting means and said second inner port means and said internal passage means of said second fluid conducting means are located within one-half of the piston at said one end thereof.

9. In a pneumatic impact device having a casing with a bore providing an impact piston operating cylinder, an impact piston with a coaxial through bore, mounted for axial reciprocation within the operating cylinder, an elongated pressure fluid delivery tube mounted to extend coaxially within one end of the piston operating cylinder and sealingly received within the piston bore at a corresponding one end of the piston, the impact piston having a non-impact end face at its said one end and an impact end face at its other end, the pressure fluid delivery tube having outlet port means for the delivery of pressure fluid for sequential supply to the opposite ends of the piston operating cylinder for and upon reciprocation of the piston, and impact receiving means having an inner end mounted within the casing at the other end of the piston operating cylinder from said delivery tube for impact by the impact end face of the piston; the impact device having pressure fluid exhaust means in continuous fluid communication with the piston bore at said other end of the piston and cooperating with the piston for selectively connecting said other end of the piston operating cylinder to exhaust for and upon reciprocation of the piston, and fluid passageway means to automatically supply pressure fluid from the outlet port means of the delivery tube sequentially to the opposite ends of the piston operating cylinder for and upon reciprocation of the piston and to selectively and automatically connect said one end of the piston operating cylinder to exhaust via the piston bore at said other end of the piston and said exhaust means for and upon reciprocation of the piston, said fluid passageway means comprising first and second separate fluid conducting means provided by the piston with respective first and second separate inner port means in the piston opening into the piston bore; said first fluid conducting means being located to selectively connect said one end of the piston operating cylinder to exhaust via the piston bore at said other end of the piston and said exhaust means for and upon reciprocation of the piston; the improvement wherein said second fluid conducting means comprises peripheral port means in the piston, including a peripheral annular groove in the piston providing a non-exhausted pressure fluid chamber, and internal passage means in the piston interconnecting said peripheral port means with said second inner port means in the piston, said piston having first and second peripheral sealing sections disposed toward the non-impact and impact end faces of the piston respectively from said peripheral port means in the piston for sealing engagement with said casing, the fluid passageway means further comprising first and second separate, axially spaced bypass means in the casing cooperating with said first and second peripheral sealing sections respectively to sequentially connect said outlet port means via said second fluid conducting means, including said peripheral annular groove in the piston, and said first and second bypass means to the opposite ends of the piston operating cylinder, when said opposite ends respectively of the piston operating cylinder are not connected to exhaust, for and upon reciprocation of the piston.

10. A pneumatic impact device according to claim 9 wherein said first fluid conducting means is located to selectively and alternately connect said one end of the piston operating cylinder to said outlet port means and to exhaust via the piston bore at said other end of the piston and said exhaust means for and upon reciprocation of the piston.

11. A pneumatic impact device according to claim 10 wherein said first fluid conducting means and said second fluid conducting means and first bypass means selectively and automatically connect said outlet port means to said one end of the piston operating cylinder during different portions of reciprocable movement of the impact piston.

12. In an axially reciprocable impact piston having a coaxial through bore and non-impact and impact end faces at respectively one end thereof and the other end thereof, the impact piston being adapted for use in a pneumatic impact device having a casing with a bore providing an impact piston operating cylinder for axial reciprocation of the impact piston therein, a pneumatic pressure fluid delivery tube mounted to extend coaxially within one of the piston operating cylinder for being sealingly received within the piston bore at said one end thereof and having peripheral outlet port means for the delivery of pressure fluid for reciprocation of the piston, an impact member having an end mounted at the other end of the piston operating cylinder from the fluid delivery tube for impact by the impact end face of the piston, and exhaust means in fluid communication with the piston bore at said other end of the piston and adapted for cooperation with the piston for selectively connecting said other end of the piston operating cylinder to exhaust for and upon reciprocation of the piston, the casing having first and second separate, axially spaced bypass means respectively disposed towards said one end and said other end of the piston operating cylinder to sequentially supply pressure fluid thereto for and upon reciprocation of the piston; the impact piston having first and second separate fluid conducting means with respective first and second separate, axially spaced, inner annular grooves opening into the piston bore for fluid communication with said peripheral outlet port means for supplying pressure fluid to the opposite ends of the piston operating cylinder for and upon reciprocation of the piston; the improvement wherein said first and second separate fluid conducting means of the piston comprise first and second separate peripheral groove means in the piston respectively, which include first and second separate axially spaced peripheral annular grooves in the piston respectively, and first and second separate internal passage means in the piston interconnecting the first and second inner annular grooves respectively with the first and second peripheral annular grooves respectively, said second peripheral annular groove providing a non-exhausted pressure fluid chamber, said first peripheral groove means and said second inner annular groove being disposed axially closer to the non-impact end face of the piston than said second peripheral groove means and said first inner annular groove respectively, said first inner annular groove and said first peripheral groove means being operable to alternately connect the piston operating cylinder at said one end of the piston to receive pressure fluid and to exhaust via the piston bore at said other end of the piston, the piston having first and second separate, axially spaced peripheral sealing sections, said first peripheral sealing section being disposed toward the non-impact end face of the piston between said first and second peripheral groove means and said second peripheral sealing section being disposed toward the impact end face of the piston from said second peripheral groove means, the first and second peripheral sealing sections being operable to cooperate respectively with axially spaced bypass means in the casing to sequentially supply pressure fluid via said second fluid conducting means, including said second peripheral annular groove, to the piston operating cylinder at the opposite ends of the piston for and upon reciprocation of the piston.

13. An impact piston according to claim 12 wherein said first fluid conducting means and said second inner annular groove and second internal passage means of said second fluid conducting means are located within one-half of the piston at said one end thereof.

14. An axially reciprocable impact piston having impact and non-impact end faces at opposite impact and non-impact axial ends thereof and adapted to be pneumatically reciprocated by sequentially and automatically connecting the opposite axial end faces of the piston to receive pneumatic pressure fluid and to exhaust for and upon reciprocation of the piston, the impact piston having a coaxial through bore for receiving pressure fluid via the piston bore at the non-impact end of the piston and for exhausting pressure fluid via the piston bore at the impact end of the piston, the piston having first and second separate fluid conducting means with first and second separate, axially spaced, inner port means respectively opening into the piston bore, first and second separate, axially, spaced peripheral groove means respectively and first and second separate internal passagemeans interconnecting the first and second inner port means respectively with the first and second peripheral groove means respectively, the second peripheral groove means comprising a peripheral annular groove in the piston providing a non-exhausted pressure fluid chamber, said first peripheral groove means and said second inner port means being disposed toward the non-impact end face of the piston from said second peripheral groove means and said first inner port means respectively, said first inner port means and said first peripheral groove means connecting the non-impact end face of the piston to the piston bore to alternately receive pressure fluid via the non-impact end of the piston bore and exhaust pressure fluid via the impact end of the piston bore, the piston having first and second separate, axially spaced, pripheral sealing sections, said first peripheral sealing section being disposed between said first and second peripheral groove means and said second peripheral sealing section being disposed toward the impact end face of the piston from said second peripheral groove means.

15. An impact piston according to claim 14 wherein the first peripheral groove means comprises a peripheral annular groove in the piston.

16. An axially reciprocable impact piston having impact and non-impact end faces at opposite impact and non-impact axial ends thereof and adapted to be pneumatically reciprocated by sequentially and automatically connecting the opposite end faces of the piston to receive pneumatic pressure fluid and to exhaust for and upon reciprocation of the piston, the impact piston having a coaxial through bore for receiving prsesure fluid via the piston bore at the non-impact end of the piston and for exhausting pressure fluid via the piston bore at the impact end of the piston, the piston having first and second separate fluid conducting means with first and second separate, axially spaced, inner port means respectively, opening into the piston bore, said first fluid conducting means connecting the non-impact end face of the piston to the piston bore an being provided for selectively and automatically connecting the non-impact end face of the piston to exhaust via the piston bore at the impact end of the piston, and said second fluid conducting means comprising peripheral groove means including a peripheral annular groove in the piston providing a non-exhausted pressure fluid chamber, and internal passage means interconnecting the second inner port means with the peripheral groove means, said second fluid conducting means being provided for automatically and sequentially connecting the opposite end faces of the piston to receive pressure fluid via the piston bore at the non-impact end of the piston, the piston having first and second separate, axially spaced, peripheral sealing sections respectively disposed toward the non-impact end face of the piston and the impact end face of the piston from said peripheral groove means to control said connection of the opposite end faces of the piston to receive pressure fluid and to prevent connection of said peripheral annular groove to exhaust.

17. A reciprocable impact piston having non-impact and impact end faces at opposite impact and non-impact axial ends thereof and adapted to be pneumatically reciprocated by sequentially and automically supplying pneumatic pressure fluid to and exhausting it from the opposite axial end faces of the piston for and upon reciprocation of the piston, the impact piston having a coaxial through bore for receiving pressure fluid via the piston bore at the non-impact end of the piston and for exhausting pressure fluid via the piston bore at the impact end of the piston, the piston having first and second separate fluid conducting means with first and second separate axially spaced, inner annular grooves respectively opening into the piston bore, said second fluid conducting means further comprising peripheral groove means including a peripheral annular groove in the piston providing a non-exhausted pressure fluid chamber, and internal passage means connecting said second inner annular groove with said peripheral groove means, said first fluid conducting means further comprising passage means interconnecting the non-impact end face of the piston to said first inner annular groove, the piston having first and second separate, axially spaced, peripheral sealing sections disposed on opposite axial sides of said peripheral groove means.

18. An impact piston according to claim 17 wherein said first fluid conducting means and said second inner annular groove and internal passage means of said second fluid conducting means are located within one-half of the piston at the non-impact end thereof.

19. In a pneumatic downhole impact drill having an elongated generally cylindrical casing with a longitudinally extending bore providing an impact piston operating cylinder, an impact piston with a coaxial through bore, mounted for axial reciprocation with the operating cylinder, a pressure fluid delivery tube mounted within one end of the elongated casing to extend coaxially within a corresponding one end of the piston operating cylinder and sealingly received within the axial bore of the impact piston at a corresponding one end of the piston, the impact piston having a non-impact end face at its said one end and impact end face at its other end, the pressure fluid delivery tube having peripheral outlet port means for the delivery of pressure fluid for sequential supply to the opposite ends of the piston operating cylinder for and upon reciprocation of the piston, and impact receiving means with an inner end mounted at the other end of the piston operating cylinder from the fluid delivery tube for impact by the impact end face of the piston, the impact drill having exhaust means for connecting the piston bore at said other end of the piston to exhaust and cooperating with the impact piston for selectively and automatically connecting said other end of the piston operating cylinder to exhaust for and upon reciprocation of the piston, the impact drill further having fluid passgeway means to automatically supply pressure fluid from the peripheral outlet port means sequentially to the opposite ends of the piston operating cylinder for and upon reciprocation of the piston and to selectively and automatically connect said one end of the piston operating cylinder to exhuast, via the piston bore at said other end of the piston and said exhaust means, for and upon reciprocation of the piston, said fluid passageway means comprising first and second separate fluid conducting means provided by the piston with first and second separate, axially spaced, inner annular grooves respectively in the piston opening into the piston bore for fluid communication with the peripheral outlet port means in the delivery tube for and upon reciprocation of the piston, said first fluid conducting means being operable to selectively connect said one end of the piston operating cylinder via said first inner annular groove to said peripheral outlet port means and to exhaust via said axial bore at said other end of the piston for and upon reciprocation of the piston; the improvement wherein said second fluid conducting means comprises peripheral groove means in the piston, including a peripheral annular groove in the piston providing a non-exhausted pressure fluid chamber and internal passage means in the piston interconnecting the peripheral groove means with said second inner annular groove, said piston having first and second, separate, axially spaced peripheral sealing sections for sealing engagement with the casing, said peripheral groove means in the piston being located between said sealing sections, said fluid passageway means further comprising first and second separate, axially spaced bypass passage means in the casing cooperating with the first and second peripheral sealing sections of the piston to sequentially supply pressure fluid from said peripheral outlet port means via said second fluid conducting means, including said peripheral annular groove in the piston, to the opposite ends of the piston operating cylinder for and upon reciprocation of the piston.

20. A pneumatic downhole impact drill according to claim 19 wherein the pressure fluid delivery tube comprises a single internal axial bore for supplying pressure fluid to said peripheral outlet port means of the delivery tube.

21. A pneumatic impact device according to claim 9 wherein said first inner port means in the piston and said outlet port means in the fluid delivery tube cooperate to selectively connect said outlet port means to supply pressure fluid via said first fluid conducting means to said one end of the piston operating cylinder for and upon reciprocation of the piston.

22. A pneumatic impact device according to claim 9 wherein said first and second bypass means in the casing and said peripheral port means in the piston provide cooperating porting means in the casing and piston for conducting pressure fluid to each end of the piston operating cylinder for and upon reciprocation of the piston.

* * * * *